US008808533B2

(12) United States Patent
Nocca et al.

(10) Patent No.: US 8,808,533 B2
(45) Date of Patent: Aug. 19, 2014

(54) PROCESS FOR SELECTIVE REDUCTION OF THE CONTENTS OF BENZENE AND LIGHT UNSATURATED COMPOUNDS OF DIFFERENT HYDROCARBON FRACTIONS

(75) Inventors: Jean Luc Nocca, Houston, TX (US); Quentin Debuisschert, Rueil Malmaison (FR)

(73) Assignee: IFP Energies Nouvelles, Rueil-Malmaison Cedex (FR)

( * ) Notice: Subject to any disclaimer, the term of this patent is extended or adjusted under 35 U.S.C. 154(b) by 964 days.

(21) Appl. No.: 12/765,962

(22) Filed: Apr. 23, 2010

(65) Prior Publication Data

US 2011/0259792 A1 Oct. 27, 2011

(51) Int. Cl.
*C10G 45/00* (2006.01)

(52) U.S. Cl.
USPC ..... 208/57; 585/264; 585/265; 208/145

(58) Field of Classification Search
USPC ..... 208/143
See application file for complete search history.

(56) References Cited

U.S. PATENT DOCUMENTS

| | | | | |
|---|---|---|---|---|
| 3,759,819 | A * | 9/1973 | Attane | 208/57 |
| 5,770,047 | A * | 6/1998 | Salazar et al. | 208/254 R |
| 5,817,227 | A * | 10/1998 | Mikitenko et al. | 208/143 |
| 6,740,787 | B2 * | 5/2004 | Pinault et al. | 585/259 |
| 2010/0063334 | A1 * | 3/2010 | Vichailak et al. | 585/258 |

* cited by examiner

*Primary Examiner* — Randy Boyer
*Assistant Examiner* — Juan Valencia
(74) *Attorney, Agent, or Firm* — Millen, White, Zelano & Branigan, P.C.

(57) ABSTRACT

Process for treatment of a feedstock, such as hydrocarbons that comprise at least 4 carbon atoms per molecule and that comprise at least one unsaturated compound including benzene, such that said feedstock is treated in a distillation zone, associated with a hydrogenation reaction zone, at least in part outside of the distillation zone, and an isomerization zone, so as to discharge—at the top of the distillation zone and at the bottom of the distillation zone—an effluent that is low in unsaturated compounds, whereby said process comprises the treatment of at least a second feedstock, comprising at least one unsaturated compound including benzene, at least partially directly injected into the hydrogenation zone that is outside of the distillation zone.

21 Claims, 3 Drawing Sheets

Figure 1:
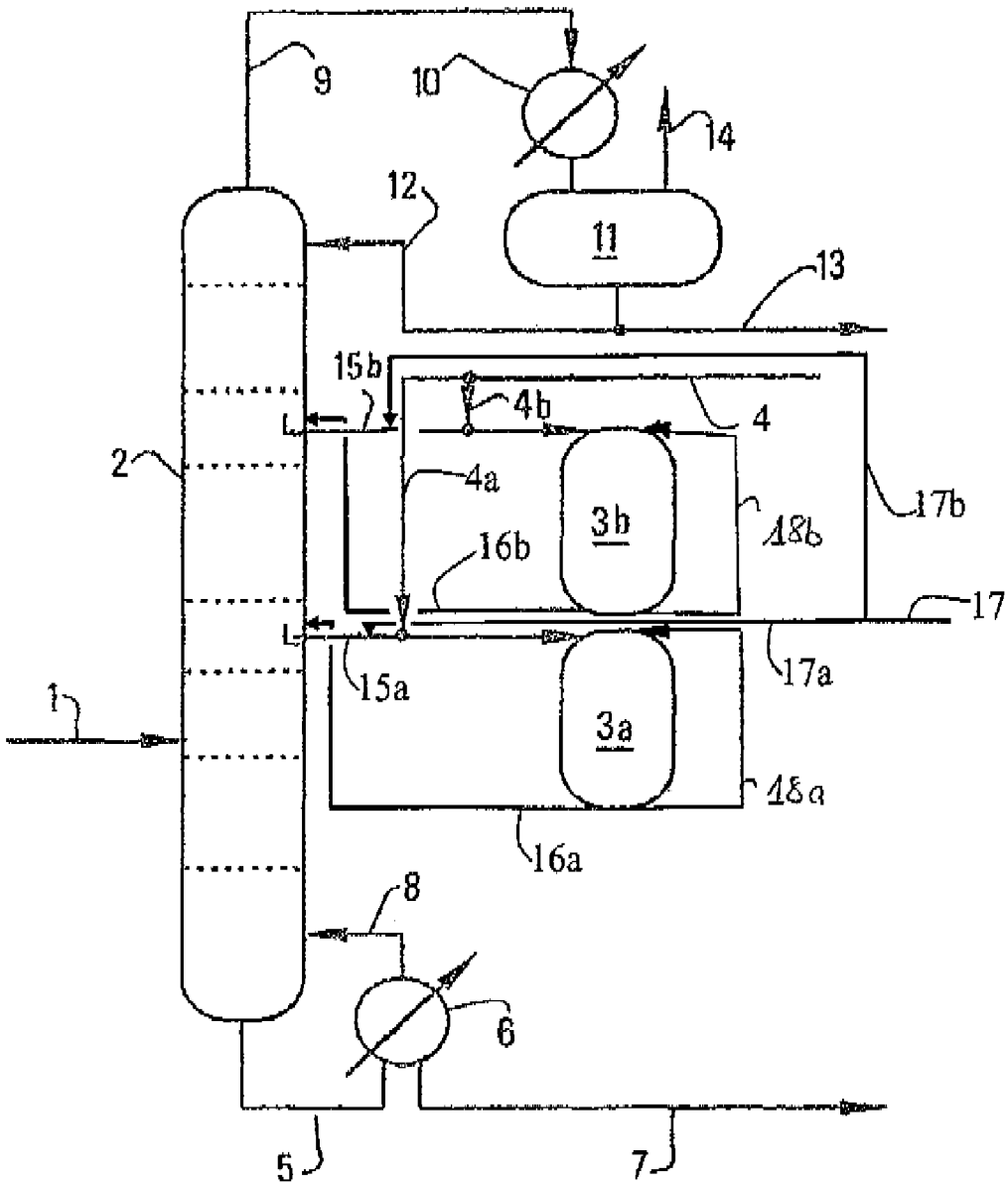

PROCESS FOR SELECTIVE REDUCTION OF THE CONTENTS OF BENZENE AND LIGHT UNSATURATED COMPOUNDS OF DIFFERENT HYDROCARBON FRACTIONS

This invention relates to a process for reduction of the contents of unsaturated compounds of a hydrocarbon fraction, and more particularly a process for selective reduction of the contents of unsaturated compounds, and in particular benzene, of at least one hydrocarbon fraction.

Taking into account the recognized harmfulness of benzene and to a lesser degree of olefins, unsaturated compounds and heavier aromatic compounds than benzene, the general tendency is to reduce the contents of these components in the gasolines.

Benzene has carcinogenic properties, and it is consequently required to limit as much as possible any possibility of polluting the ambient air, in particular by virtually excluding it from automobile fuels. In the United States, the reformulated fuels should not contain more than 0.62% benzene; in Europe, even if the specifications are not yet as strict, it is recommended to gradually strive for this value.

The olefins have been recognized as being among the most reactive hydrocarbons in the cycle of photochemical reactions with nitrogen oxides, which occurs in the atmosphere and which leads to the formation of ozone. An elevation of the ozone concentration in air can be a source of respiratory problems. The reduction of the olefin contents of the gasolines, and more particularly of the lightest olefins that have a greater tendency to volatilize when the fuel is handled, is consequently desirable.

The aromatic compounds that are heavier than the benzene also have—but to a lesser degree—carcinogenic properties and see their contents in the gasoline pools gradually reduced.

The benzene content of a gasoline is very highly dependent on that of the different fractions that compose it. These different fractions are in particular:

- The reformate that results from a catalytic treatment of naphtha that is designed to produce aromatic hydrocarbons, primarily comprising 4 to 12 carbon atoms in their molecule and whose very high octane number imparts to the gasoline its anti-detonation properties. These fractions that are obtained from catalytic reforming have been the only ones treated up until now to reach benzene specifications in gasoline pools with 1% volume. To go lower in terms of specification and, for example, at 0.62% volume, it is necessary that other fractions be treated, and in particular the fractions that are presented in detail below.
- The C5/C6 fractions such as:
  - The straight-run distillation light naphtha (light straight run),
  - The naphtha that is produced by the hydrocracking unit,
- Other fractions that are enriched with benzene and heavier aromatic compounds by distillation and hydrotreatment and obtained from a catalytic cracking unit or FCC (fluid catalytic cracking according to the English terminology) and the light gasolines from a delayed or fluid coking unit (coker according to the English terminology), flexicoker or viscoreduction unit (visbreaking according to the English terminology),
- The fractions that are enriched with benzene and heavier aromatic compounds that are obtained after separation and hydrotreatment of gasolines obtained from cracking olefins (cracking of $C_4$ to $C_{10}$ olefins into ethylene and propylene on an acid catalyst),

- The fractions that are rich in benzene and heavier aromatic compounds that are obtained from a unit for production of steam-cracker-type olefins (pyrolysis gasoline according to the English terminology) or coke ovens (coke oven light oil according to the English terminology) after distillation and hydrotreatment.

Because of the harmfulness factors described above, it is therefore necessary to reduce the contents of benzene and heavier aromatic compounds of these different fractions as much as possible. Several approaches can be considered.

A first approach consists in limiting, in the naphtha that constitutes the feedstock of a catalytic reforming unit, the contents of precursors of the benzene, such as cyclohexane and methylcyclopentane. This solution effectively makes it possible to considerably reduce the benzene content of the effluent from the reforming unit but it is not always sufficient by itself when it is a matter of dropping to contents as low as 0.62%.

A second approach consists in eliminating, by distillation, a light fraction of the reformate that contains benzene. This solution leads to a loss on the order of 15 to 20% hydrocarbons that could be upgraded in the gasolines.

A third approach consists in extracting the benzene that is present in the effluent from the reforming unit. Several known techniques can be applied in principle: extraction by solvent, extractive distillation, or adsorption. These technologies have a high cost and require an opening for the extracted benzene fraction.

A fourth approach consists in chemically transforming the benzene to convert it into a component that is not targeted by legal limitations. Alkylation by ethylene, for example, transforms the benzene primarily into ethylbenzene. This operation is expensive, however, because of the intervention of secondary reactions that require costly energy separations.

The benzene of a reformate can also be hydrogenated in cyclohexane. Since it is impossible to hydrogenate selectively the benzene of a hydrocarbon mixture that also contains toluene and xylenes, it is therefore necessary, if it is desired to convert only benzene, to fractionate this mixture in advance so as to isolate a fraction that contains only benzene, which can then be hydrogenated.

A solution for selectively reducing the benzene in a hydrocarbon fraction is described in the patent EP 0 781 830. This patent relates to a process for treatment of a feedstock, constituting for the most part hydrocarbons that comprise at least 5 carbon atoms per molecule and that comprise at least one unsaturated compound that comprises at most six carbon atoms per molecule including benzene, in which said feedstock is treated in a distillation zone, comprising a drainage zone and a rectification zone, combined with a hydrogenation reaction zone, at least at the outer part in the distillation zone, comprising at least one catalytic bed. The feedstock of the reaction zone is sampled at the height of a sampling level, whereby the effluent from the reaction zone is at least in part reintroduced into the distillation zone at least one level for reintroduction, so as to ensure the continuity of the distillation, and so as to finally discharge—at the top of the distillation zone—an effluent that is very low in unsaturated compounds and that comprises at most six carbon atoms per molecule and—at the bottom of the distillation zone—an effluent that is low in unsaturated compounds and that comprises at most six carbon atoms per molecule.

One drawback of this technique is that it provides for treating only the reformate that results from a naphtha catalytic treatment; however, it is also necessary to reduce the quantity of light unsaturated compounds, and in particular of the benzene, from all of the fractions that can be incorporated into the gasoline pool without increasing the costs that are linked to the distillation stage.

This invention therefore has as its object to overcome one or more of the drawbacks of the prior art by proposing a process that makes it possible to produce—at low cost and from different hydrocarbon fractions—a product that is low in unsaturated compounds and in particular benzene or, if necessary, totally purified of unsaturated compounds and in particular of benzene, without a significant loss of yield and with very little loss of octane number.

For this purpose, this invention proposes a process for treating a feedstock, consisting in large part of hydrocarbons that comprise at least 4 carbon atoms per molecule and that comprise at least one unsaturated compound including benzene, such that said feedstock is treated in a distillation zone, a drainage zone, and a rectification zone, combined with a hydrogenation reaction zone, at least in part outside of the distillation zone, comprising at least one catalytic bed, in which the hydrogenation of at least one portion of the unsaturated compounds contained in the feedstock is carried out in the presence of a hydrogenation catalyst and a gaseous stream that comprises hydrogen, whereby the feedstock of the reaction zone is sampled at least one sampling level in the distillation zone, whereby the effluent from the reaction zone is at least in part reintroduced into the distillation zone at least one reintroduction level to ensure the continuity of the distillation and to discharge—at the top of the distillation zone in a lateral draw-off located above the return line of the reaction zone into the distillation zone, and at the bottom of the distillation zone—an effluent that is low in unsaturated compounds, whereby said process is characterized in that it comprises the treatment of at least a second feedstock, comprising at least one unsaturated compound including benzene, at least partially directly injected into the hydrogenation reaction zone that is outside of the distillation zone.

According to one embodiment of the process, the lateral draw-off is carried out above the return line of the reaction zone.

According to another embodiment of the process, the lateral draw-off is carried out below the return line of the reaction zone.

According to another embodiment of the process, the second feedstock is injected with the remainder injected into the hydrogenation internal zone of the distillation column.

According to one embodiment of the process, the second feedstock consists of at least hydrocarbons that comprise at least 4 carbon atoms per molecule.

According to one embodiment of the process, the second feedstock consists of a $C_5/C_6$ fraction of the straight-run distillation light naphtha type and/or of the naphtha type that is produced by a hydrocracking unit and/or by fractions that are enriched with benzene and/or toluene and that are low in sulfur and nitrogen that are obtained from catalytic cracking and/or by gasoline fractions that consist of fractions that are enriched with benzene and/or toluene and that are low in sulfur and nitrogen that are obtained from coking or viscoreduction units, and/or by fractions that are enriched with benzene and/or toluene, low in sulfur and nitrogen, and obtained after cracking of olefins or oligocracking, and/or by fractions that are rich in benzene and/or toluene, low in sulfur and nitrogen, and obtained from a unit for production of olefins by steam-cracking.

According to another embodiment of the process, the second feedstock consists of at least one feedstock that is selected from among:

- Hydrocarbons that comprise at least 4 carbon atoms per molecule,
- A $C_5/C_6$ fraction of the straight-run distillation light naphtha type,
- A $C_5/C_6$ fraction of the naphtha type that is produced by a hydrocracking unit,
- A gasoline fraction of the catalytic cracking core that is enriched with benzene relative to the complete gasoline of catalytic cracking,
- A fraction of light gasolines from a coking unit that is enriched with benzene relative to the complete coking gasoline,
- A fraction that is enriched with benzene that is obtained after separation and hydrotreatment of gasolines obtained from cracking olefins or oligocracking,
- A benzene-rich fraction that is obtained from a unit for producing olefins by steam-cracking.

According to one embodiment of the process, the distillation is implemented under a pressure of between 0.2 and 2 MPa, at a reflux rate that is between 0.5 and 10, whereby the distillation zone top temperature is between 40 and 180° C., and the distillation zone bottom temperature is between 120 and 280° C.

According to one embodiment of the process, the hydrogenation reaction zone is completely outside of the distillation zone.

According to one embodiment of the process, a portion of the effluent from the hydrogenation reactor is recycled at the inlet of the reactor.

According to one embodiment of the process, the hydrogenation reaction zone is both partially incorporated in the rectification zone of the distillation zone and partially outside of the distillation zone.

According to one embodiment of the process, the hydrogenation reaction, implemented in the portion of the hydrogenation zone that is inside of the distillation zone, is conducted at a temperature of between 100 and 200° C., at a pressure of between 0.2 and 2 MPa, and at a volumetric flow rate within the internal hydrogenation reaction zone that is calculated relative to the catalyst, encompassed between 1 and 50 $h^{-1}$, and the flow rate of the hydrogen supplying the hydrogenation reaction zone is encompassed between 0.5 and 10 times the flow rate that corresponds to the stoichiometry of the hydrogenation reactions involved.

According to another embodiment of the process, the hydrogenation reaction that is carried out in the external portion of the distillation zone is carried out at a pressure of between 0.1 and 6 MPa, a temperature of between 100 and 400° C., and a volumetric flow rate within the hydrogenation reaction zone, calculated relative to the catalyst, generally between 1 and 50 $h^{-1}$, and a hydrogen flow rate that corresponds to the stoichiometry of the hydrogenation reactions involved is between 0.5 and 10 times said stoichiometry.

According to one embodiment of the process, a stage for isomerization of the feedstock of the reaction zone sampled at least one sampling level is carried out in the distillation zone.

According to one embodiment of the process, the isomerization stage is carried out in the hydrogenation reactor at the same time as the hydrogenation reaction.

According to one embodiment of the process, the isomerization stage is carried out outside of the hydrogenation reactor and downstream from the hydrogenation stage.

According to one embodiment of the process, the hydrogenation catalyst is in contact with a downflowing liquid phase and with an upflowing vapor phase for any catalytic bed of the inner portion of the hydrogenation reaction zone.

According to one embodiment of the process, the gaseous stream that comprises the hydrogen that is necessary for the hydrogenation reaction zone is adjacent to the vapor phase, approximately at the inlet of at least one catalytic bed of the hydrogenation reaction zone.

According to one embodiment of the process, the flow of the liquid that is to be hydrogenated is co-current to the flow of the gaseous stream that comprises hydrogen for any catalytic bed of the inside portion of the hydrogenation reaction zone.

According to one embodiment of the process, the flow of the liquid to be hydrogenated is co-current to the flow of the gaseous stream that comprises hydrogen and such that the distillation vapor is virtually not in contact with the catalyst for any catalytic bed of the inner portion of the hydrogenation reaction zone.

According to one embodiment of the process, any catalyst that is used in the hydrogenation reaction zone comprises at least one metal that is selected from the group that is formed by nickel, zirconium and platinum.

According to one embodiment of the process, the metal is on a chlorinated alumina substrate or a zeolitic alumina substrate.

The invention also relates to the use of the process for the preparation of a paraffin isomerization feedstock of improved quality.

Figure 2:
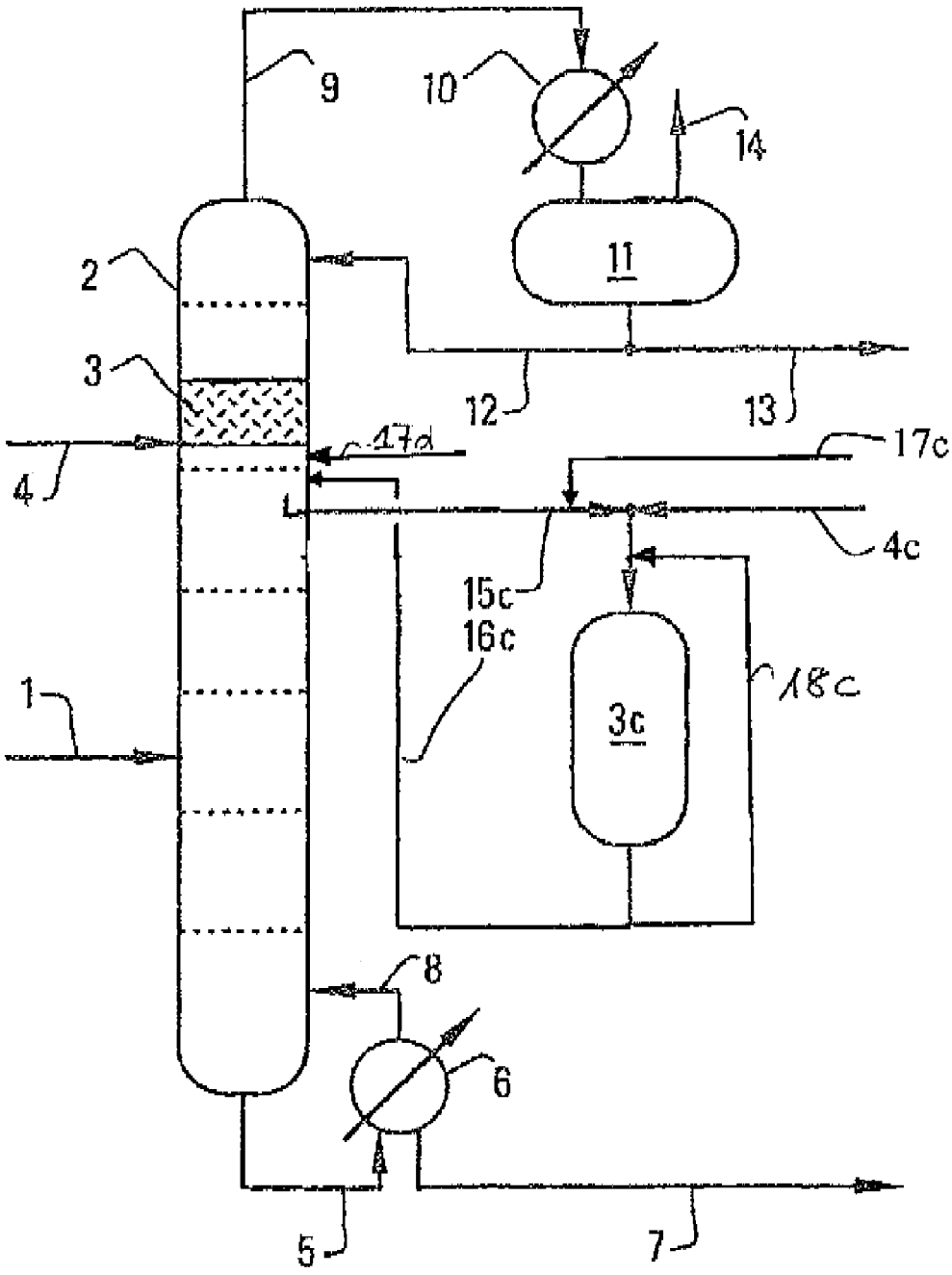
Figure 3:
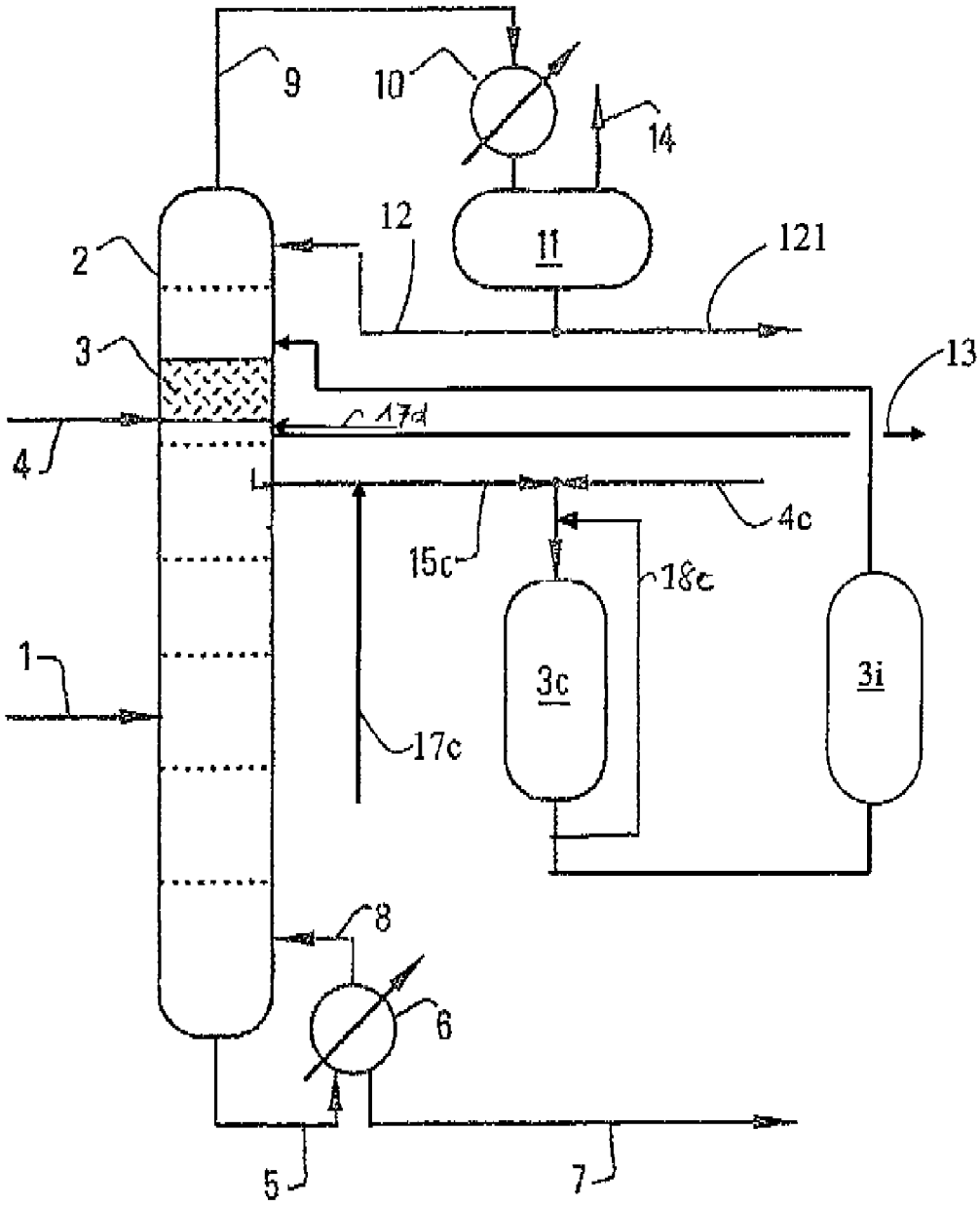

Other characteristics and advantages of the invention will be better understood and will appear more clearly from reading the description given below by referring to the accompanying figures and provided by way of example:

FIG. 1 is a schematic representation of the process according to the invention for the reduction of the contents of light unsaturated compounds of a hydrocarbon fraction, FIG. 2 is a schematic representation of a variant of the process according to the invention for the reduction of the contents of light unsaturated compounds of a hydrocarbon fraction, FIG. 3 is a schematic representation of another variant of the process according to the invention for the reduction of the contents of light unsaturated compounds of a hydrocarbon fraction.

The process according to the invention, illustrated in FIGS. 1 to 3, consists in reducing the contents of light unsaturated compounds of 6 to 12 carbon atoms, including benzene, of different hydrocarbon fractions. The process thus makes it possible to produce a fuel, and more particularly a gasoline, whose benzene content is reduced so as to comply with the standards in force while maintaining a good octane number.

The process for the reduction of the light unsaturated compound contents according to the invention comprises a distillation operation, a hydrogenation operation, and, in some cases, an isomerization operation, arranged and operated so as to minimize the investment cost of the process, to maximize the conversion of the unsaturated products while minimizing the consumption of hydrogen and maximizing the yield of distillate and residue obtained from the column, with a suitable benzene content in light unsaturated compounds, including benzene.

The process according to the invention is a process for treatment of at least one feedstock, consisting for the most part of hydrocarbons that comprise at least 4, preferably between 5 and 12, carbon atoms per molecule and that comprise at least one light unsaturated compound and in particular benzene. The feedstocks that are treated are, for example:

- The reformate that results from a naphtha catalytic treatment that is designed to produce aromatic hydrocarbons, primarily comprising 4 to 12 carbon atoms in their molecule and whose very high octane number imparts to the gasoline its anti-detonation properties,
- The C5/C6 fractions such as:
  - The straight-run distillation light naphtha (light straight run),
  - The naphtha that is produced by the hydrocracking unit.

The mean contents of benzene of such fractions are on the order of 2 to 10% by volume according to the treated crude and the fraction points.

These fractions contain few or no olefins and their co-treatment in a unit for hydrogenation of benzene does not lead to a significant increase in loss of octane or hydrogen consumption beyond those linked to the hydrogenation of benzene.

- Other fractions that are obtained from catalytic cracking or FCC (fluid catalytic cracking according to the English terminology) and the light gasolines from a delayed or fluid coking unit (coker according to the English terminology) or flexicoker or viscoreduction unit (visbreaking according to the English terminology).

These fractions are always olefinic and often rich in heteroatoms (sulfur, nitrogen, and chlorine) that are harmful for the catalysts for hydrogenation of benzene. They often require pretreatment before delivery to the benzene hydrogenation unit. There again, the contents depend on fraction points as well as feedstock qualities of the primary conversion unit (FCC or coker or visbreaker). These contents are typically on the order of 2 to 10% by volume, and even more if a narrow fraction is considered.

- The fractions that are enriched with benzene or other light unsaturated compounds that are obtained after separation and hydrotreatment of gasolines obtained from olefin cracking (cracking of $C_4$ to $C_{10}$ olefins into ethylene and propylene on an acid catalyst),
- Benzene-rich fractions that are obtained from a unit for production of steam-cracker-type olefins (pyrolysis gasoline according to the English terminology) or coke furnaces (coke oven light oil according to the English terminology).

A first embodiment of the process is shown in FIG. 1. The feedstock that is formed by the crude reformate, generally containing small quantities of $C_4$ hydrocarbons, is sent into a distillation column (2) via the line (1). The distillation column (2) comprises a drainage zone and a rectification zone, associated with a hydrogenation reaction zone. The distillation zone therefore comprises in general at least one column that is equipped with at least one distillation internal that is selected from the group that is formed by plates, bulk packing, and structured packing (shown in part by dotted lines in FIG. 1), as it is known to one skilled in the art, such that the total overall effectiveness is at least equal to five theoretical stages.

In this embodiment, the hydrogenation reaction zone is completely outside of the distillation zone.

The feedstock that supplies this distillation zone is introduced into said distillation zone generally at least one level of said zone, preferably primarily at a single level of said zone.

At the foot of the column (2), the least volatile fraction of the feedstock, primarily consisting of the hydrocarbons with 7 carbon atoms and more (fraction $C_7$+) is recovered via the line (5), reboiled in the exchanger (or furnace) (6), and evacuated via the line (7). The reboiling product is reintroduced into the column via the line (8). At the top of the column, the light distillate—i.e., comprising primarily 4 to 7 carbon atoms per molecule (fraction $C_{7-}$) and preferably primarily 4 to 6 carbon atoms per molecule (fraction $C_{6-}$)—is sent via the line (9) into a condenser (10) and then into a separator tank (11) where a separation takes place between a liquid phase and a vapor phase that consists primarily of optionally excess hydrogen. The vapor phase is evacuated from the tank via the line (14). The liquid phase of the tank (11) is partially sent, via the line (12), to the top of the column to ensure the reflux while the other part constitutes the liquid distillate that is evacuated via the line (13).

The light distillate can also be collected directly in lateral liquid draw-off (not illustrated) of the column, without then passing into a separator tank so as to eliminate most of the light compounds $C_4$ therefrom and to ensure a satisfactory vapor pressure.

By means of a draw-off plate that is arranged in the rectification zone or optionally the drainage zone of the column, a liquid is drawn off via the line (15*a*) and said liquid is sent into a hydrogenation reactor 3*a* either via the top according to FIG. 1, or via the bottom, after the addition of hydrogen via the lines (4) and then (4*a*) or directly into the reactor. The effluent from the hydrogenation reactor is recycled at the column via the line (16*a*), which is either above the sampling line (15*a*), as illustrated in FIG. 1, or below the sampling line (15*a*).

In the embodiment that is shown in FIG. 1, the device comprises a second external hydrogenation reactor. Via the line (15*b*), a liquid is drawn off that is sent into the hydrogenation reactor (3*b*) after hydrogen is added via the lines (4) and (4*b*) or directly into the reactor, and recycling is done in the column via the line (16*b*) that is either above the sampling line (16*a*), as illustrated in FIG. 1, or below the sampling line (16*a*).

In this case, the hydrogenation stage is carried out in two reaction zones of external hydrogenation.

For each reactor, a draw-off of the effluent (not illustrated) can be considered so as to supply, for example, another reaction section such as a paraffin isomerization section.

According to another embodiment, not illustrated, the process comprises a hydrogenation stage that is carried out in a single reaction zone of external hydrogenation.

The gas stream that is recovered in vapor distillate from the distillation column optionally containing excess hydrogen can be returned after recompression to the reactor so as to minimize the consumption of hydrogen of the system (not illustrated).

According to another embodiment of the process, shown in FIG. 2, the feedstock that is formed by the crude reformate ($C_{4+}$), generally containing small quantities of hydrocarbons ($C_{4-}$), is sent via the line (1) into a distillation column (2), equipped with distillation internals that are, for example, in the case of FIG. 2, distillation plates, as well as a catalytic internal (3) that contains a hydrogenation catalyst and that is supplied by hydrogen via the line (4).

In this embodiment, the hydrogenation reaction zone is at least in part outside of the distillation zone. In the same way as for the preceding embodiment, the distillation zone can be split up into two columns. In practice, when the hydrogenation reaction zone is at least in part inside the distillation zone, the rectification zone or the drainage zone, and preferably the drainage zone, can generally be found in at least one column that is different from the column that comprises the inside portion of the hydrogenation reaction zone.

The hydrogenation reaction zone can also be partially incorporated into the rectification zone of the distillation zone and partially outside of the distillation zone.

The top and bottom effluents of the column are treated as described above for the first embodiment of the process. From a draw-off plate that is arranged in the rectification zone of the column, a sample is taken—via the line (15*c*)—of a liquid that, after adding hydrogen via the line (4*c*), is introduced into the hydrogenation reactor (3*c*). The effluent from the hydrogenation reactor is recycled in the distillation column via the line (16*c*), which is either above the sampling line (15*c*) as illustrated in FIG. 2, or below the sampling line (15*c*). It is in this hydrogenation reaction zone (3*c*) that the hydrogenation of at least a portion of the unsaturated compounds that comprise at most six carbon atoms per molecule—i.e., comprising up to six (inclusive) carbon atoms per molecule and contained in the feedstock—is carried out.

In general, the process comprises 1 to 6, preferably 1 to 4 sampling level(s) that supply(ies) the outer portion of the hydrogenation zone. One part of the outer portion of the hydrogenation zone generally comprises at least one reactor. If the outer portion comprises at least two catalytic beds that are distributed in at least two reactors, said reactors are arranged in series or in parallel and each of said reactors is preferably supplied by a separate sampling level from the sampling level that supplies the other reactor(s).

The hydrogenation reaction zone generally comprises at least one hydrogenation catalytic bed, preferably 2 to 4 catalytic beds. The hydrogenation reaction zone at least partially carries out the hydrogenation of the benzene that is present in the feedstock, generally in such a way that the benzene content of the top effluent is at most equal to a certain content, and said hydrogenation reaction zone carries out at least in part, preferably for the most part, the hydrogenation of any unsaturated compound that comprises at most six carbon atoms per molecule and, unlike benzene, that is optionally present in the feedstock.

When the hydrogenation reaction zone is both partially incorporated in the distillation zone, i.e., inside of the distillation zone, and partially outside of the distillation zone, the hydrogenation reaction zone comprises at least two, preferably at least three, catalytic beds, at least one catalytic bed being inside of the distillation zone, and at least one catalytic bed being outside of the distillation zone. In the case where the outer portion of the hydrogenation zone comprises at least two catalytic beds, each catalytic bed is supplied by a single sampling level, preferably associated with a single reintroduction level, whereby said sampling level is separate from the sampling level that supplies the other catalytic bed(s). In general, the liquid to be hydrogenated, either partially or totally, first circulates in the outer portion of the hydrogenation zone and then in the inner portion of said hydrogenation zone. For the portion of the hydrogenation reaction zone that is inside of the distillation zone, the sampling of liquid is naturally done by flowing within the portion of the reaction zone that is inside of the distillation zone, and the reintroduction of liquid in the distillation zone is also done naturally by liquid flowing from the hydrogenation reaction zone that is inside of the distillation zone. In addition, the process is preferably such that the flow of the liquid to be hydrogenated is co-current or counter-current, preferably co-current, to the flow of the gaseous stream that comprises hydrogen, for any catalytic bed of the inner portion of the hydrogenation zone, and even more preferably such that the flow of the liquid that is to be hydrogenated is co-current to the flow of the gaseous stream that comprises hydrogen, and such that the vapor is separated from said liquid, for any catalytic bed of the inner portion of the hydrogenation zone.

The invention consists of the fact that the hydrogenation reaction zone is supplied by two separate feedstocks that are to be hydrogenated.

A first feedstock that is to be hydrogenated, as already described in the patent EP 0 781 830, is formed by the one that is sampled in the distillation column (2). This first feedstock that is to be hydrogenated is sampled via the line (15*a, b*, or *c*) at a sampling level and shows at least one portion, preferably the major part, of the liquid that flows into the distillation zone, preferably flowing into the rectification zone, and even more preferably flowing at an intermediate level of the rectification zone, preferably flowing at a level of at least 2 plates, and very preferably at least 10 plates, of the top and bottom of the column.

A second feedstock that is to be hydrogenated is injected directly into the end part of the distillation zone upstream from the hydrogenation reaction zone via the line (17*c*) or into the inner portion via the line (17*d*) or directly into the hydrogenation reaction zone when it is totally outside of the distillation column via the line (17*a, b*), and more particularly in the hydrogenation reactor.

This second feedstock can be injected at least partially or completely into the hydrogenation reaction zone that is outside of the distillation column.

In the case where it is injected at least partially, the injection can be done with the remainder injected into the inner portion of the hydrogenation reaction zone.

The second feedstock can be injected via the lines (17*a, b, c*, or *d*) after a preliminary mixing with the first feedstock that is sampled via the line (15*a, b*, or *c*) and the addition of hydrogen via the line (4*a, b*, or *c*) as illustrated in FIGS. 1 and 2.

According to another variant of the invention, the second feedstock can be injected by itself after the addition of hydrogen, i.e., without being previously mixed with the first feedstock (not illustrated).

This second feedstock can be characterized by the absence or the low content of heavy unsaturated compounds that it is desired to preserve. It can be formed by all of the following fractions that are enriched with benzene and/or heavier aromatic compounds than benzene relative to the crude gasoline fractions that are obtained from the processes in question and that are low in sulfur, nitrogen and chlorine by hydrotreatment:

- The light reformate that results from a naphtha catalytic treatment that is designed to produce aromatic hydrocarbons, primarily comprising 4 to 7 carbon atoms in their molecule (fraction $C_{7-}$, $C_{6-}$) and whose very high octane number imparts its anti-detonation properties to the gasoline,
- The C5/C6 fractions such as:
  - The straight-run distillation light naphtha (light straight run),
  - The naphtha that is produced by the hydrocracking unit.

The mean benzene contents of such fractions are on the order of 2 to 10% by volume according to the nature of the crude petroleum from which they are obtained and the fraction points.

- Other fractions that are enriched with benzene by distillation and hydrotreatment and obtained from catalytic cracking or FCC (fluid catalytic cracking according to the English terminology) and the light gasolines of a coking unit (coker according to the English terminology) (delayed, fluid or flexicoker) or viscoreduction (visbreaking according to the English terminology),
- The benzene-enriched fractions that are obtained after separation and hydrotreatment of gasolines that are obtained from cracking olefins (cracking of $C_4$ to $C_{10}$ olefins into ethylene and propylene on an acid catalyst),
- Benzene-rich fractions that are obtained from a unit for production of steam-cracker-type olefins (pyrolysis gasoline according to the English terminology) or coke furnaces (coke oven light oil according to the English terminology) after distillation and hydrotreatment.

The advantage of such an embodiment is obtained from the fact that the process thus makes it possible to treat a larger quantity of feedstocks of different natures without special investment of equipment or flagrant additional cost. Actually, the second feedstock(s) to be hydrogenated is/are directly introduced into the hydrogenation reactor without first passing through the distillation column or introduced into the distillation zone in a preferred location based on their boiling points. There is therefore little or no additional energy consumption when the column, reboiler and condenser are working.

Another advantage is obtained from the fact that since the hydrogenation of the benzene leads to a loss of octane, it is often advantageous to send the hydrogenated distillate to a paraffin isomerization unit. With conventional distillation, it is not possible to recover in the distillate the essential part of the benzene without entraining several % of $C_7$ (typically 3% and more) in the distillate. The compounds $C_7$ as well as the cyclohexane that is produced by hydrogenation of the benzene are inhibitors of the isomerization catalyst, increase the hydrogen consumption, and reduce the yield by volume of the isomerization following hydrocracking reactions. In the process according to the invention, the hydrogenation of the benzene in the reactor that is lateral to or inside of the column makes it possible to break the azeotrope between compounds $C_7$ and benzene and to recover a portion of the cyclohexane at the bottom of the column, which makes it possible to obtain a feedstock of improved quality with the isomerization unit.

According to another embodiment of the invention that is illustrated in FIG. 3, the process comprises a stage for isomerization of the feedstock of the reaction zone that is sampled at least one sampling level in the distillation zone. According to the embodiment that is illustrated in FIG. 3, this isomerization stage is carried out after the hydrogenation stage. It takes place in an isomerization reactor that is well known to one skilled in the art. In this case, a liquid, which, after adding hydrogen via the line (4*c*), is introduced into the hydrogenation reactor (3*c*), is sampled via the line (15*c*). The second feedstock that is to be hydrogenated is injected directly into the portion that is outside of the distillation zone upstream from the hydrogenation reaction zone via the line (17*c*). The effluent from the hydrogenation reactor is then sent toward the isomerization reactor (3*i*), and then it is recycled in the distillation column via the line (16*i*), which is either above the sampling line (15*c*), as illustrated in FIG. 3, or below the sampling line (15*c*). The light distillate is drawn off laterally via the line (13). This drawing-off can be carried out either below the return of the isomerization reactor via the line 16*i* (as illustrated in FIG. 3), or above (not illustrated in FIG. 3) the return of the isomerization reactor via the line 16*i*. The line 121 is used for regulating the vapor pressure by extraction of liquid. This liquid may be enhanced downstream.

According to another non-illustrated variant, the isomerization reactor may have taken place in the same reactor as the hydrogenation reaction. When the isomerization reaction takes place in the hydrogenation reactor, the reaction is done either at the same time or following the hydrogenation, for example by means of two consecutive beds in which a hydrogenation catalyst and an isomerization catalyst are arranged in succession.

As described above, the hydrogenation reaction zone can be completely outside of the distillation zone or partially outside of it. In this case, the isomerization reaction—when it takes place in the same reactor as the hydrogenation reaction—takes place in the portion of the hydrogenation zone that is outside of the distillation zone.

When the process uses two hydrogenation reactors, the isomerization reaction can be carried out in each of the two hydrogenation reactors, or it can be carried out in two isomerization reactors that are each arranged downstream from a hydrogenation reactor (not illustrated). The process can thus comprise two isomerization stages when there are two hydrogenation stages.

This isomerization stage makes it possible to improve the octane number of the feedstock that is obtained.

The process thus relates to reactions that produce one (or more) products that have boiling points that are less than and/or almost identical to the boiling point of the reagents, more particularly the case of the hydrogenation of olefins that have at most six carbon atoms in their molecule and benzene in the light fraction of the reformate (see Table 1 below). In this fraction, the olefins are generally branched by nature and the corresponding alkanes are lighter than said olefins. The benzene, another reagent in this fraction, differs very little in boiling point from the primary product of its hydrogenation reaction, the cyclohexane (boiling point difference of 0.6° C.). Therefore, under conditions that are necessary for ensuring that heavier products remain at the bottom of the column, the cyclohexane is generally shared between the effluents at the top and at the bottom of the column. Another product that is obtained from the hydrogenation reaction of benzene is methylcyclopentane. This product is particularly promoted by hydrogenation catalysts that have strong acidities. When the isomerization is implemented in the hydrogenation reactor, one of the particularly preferred catalysts according to the invention is platinum on chlorinated and/or fluorinated alumina. This type of catalyst has a relatively high acidity and therefore promotes the hydrogenation reaction with isomerization of benzene into methylcyclopentane, which is characterized by a boiling point that is considerably less than that of benzene.

Another type of catalyst that can be used within the scope of the invention for the isomerization reaction comprises at least one metal that is selected from among nickel, zirconium and platinum, whereby the metal is on a chlorinated alumina substrate or a zeolitic alumina substrate. This type of catalyst can be used as a hydrogenation and isomerization catalyst when the isomerization stage takes place in the same reactor as that of the hydrogenation stage or it can be used in addition to the hydrogenation catalyst if the two reactions do not take place in the same reactor.

TABLE 1

| Compounds to be Hydrogenated and Products | Boiling Point (° C.) | According to the Invention, the Compounds Distill |
|---|---|---|
| 2-Methyl butene-1 (Reagent) | 31.2 | At the Top |
| 3-Methyl butene-2 (Reagent) | 38.6 | At the Top |
| 2-Methylbutane (Product) | 27.8 | At the Top |
| Benzene (Reagent) | 80.1 | At the Top |
| Cyclohexane (Product) | 80.7 | At the Top/At the Bottom |
| Methylcyclopentane (Product) | 71.8 | At the Top |

The process according to the invention thus makes it possible to hydrogenate a large portion of the compound(s) to be hydrogenated outside of the distillation zone and optionally under pressure and/or temperature conditions that are different from that used in the column.

The hydrogenation reaction is an exothermic reaction. In some cases, the quantity of reagent that is to be hydrogenated is significant. To limit the evaporation of the effluents of this reaction, it is possible to advantageously carry out the hydrogenation reaction in the zone that is located outside of the column at a pressure that is higher than the one that is used inside of the distillation zone. This pressure increase also makes possible an increased dissolution of the gaseous stream that contains hydrogen in the liquid phase that contains the compound(s) to be hydrogenated.

According to another variant of the invention, a portion of the effluent from the reactor optionally can be recycled directly at the inlet of the hydrogenation reactor (18*a*), (18*b*), and (18*c*) without going past the column again and after optional elimination of a gaseous fraction.

The process is such that the flow of the liquid to be hydrogenated is generally in co-current to the flow of the gaseous stream that comprises hydrogen for any catalytic bed of the outer part of the hydrogenation zone.

For the implementation of the hydrogenation, the theoretical molar ratio of hydrogen that is necessary for the desired conversion of benzene is 3. The quantity of hydrogen that is distributed upstream from or in the hydrogenation zone is optionally in excess relative to this stoichiometry, especially since in addition to the benzene that is present in the feedstock, any unsaturated compound that comprises at most nine carbon atoms per molecule and preferably at most 7 carbon atoms and even more preferably at most 6 carbon atoms and is present in said feedstock is to be at least partially hydrogenated. The excess hydrogen, if it exists, advantageously can be recovered, for example, according to one of the techniques that is described below. According to a first technique, the excess hydrogen that exits from the hydrogenation reaction zone is recovered after separation from the liquid fraction that is obtained from the reactor; it is then compressed and reused in said reaction zone.

According to a second technique, the excess hydrogen that exits from the reaction zone is recovered, and then injected upstream from the compression stages associated with a catalytic reforming unit, in a mixture with the hydrogen that is obtained from said unit, whereby said unit preferably operates at low pressure, i.e., generally a pressure of less than 8 bar (1 bar=$10^5$ Pa).

According to a third technique, the excess hydrogen of the reaction section is recovered in the vapor distillate and then recompressed to be reinjected upstream from or directly into the reactor.

The hydrogen, included in the gaseous stream, used in the process of the invention for the hydrogenation of unsaturated compounds can be obtained from all sources that produce hydrogen at least 50% by volume of purity, preferably at least 80% by volume of purity, and even more preferably at least 90% by volume of purity. For example, it is possible to cite the hydrogen that is obtained from the processes for catalytic reforming, methanation, P.S.A. (adsorption by alternating pressure), electrochemical generation or steam-cracking.

One of the preferred embodiments of the process, independently or not of the preceding embodiments, is such that the bottom effluent from the distillation zone is mixed at least in part with the top effluent from said zone. The thus obtained mixture can, after optional stabilization, be used as a fuel either directly or by incorporation with fuel fractions.

When the hydrogenation zone is at least partly incorporated with the distillation zone, the hydrogenation catalyst can be arranged in the incorporated part according to the different technologies that are proposed for conducting catalytic distillations. They are essentially of two types.

According to the first type of technology, the reaction and the distillation simultaneously proceed in the same physical space, as taught, for example, by the patent application WO-A-90/02,603 and, for example, the U.S. Pat. Nos. 4,471, 154 or 4,475,005. The catalyst is then generally in contact with a downflowing liquid phase, generated by the reflux that is introduced at the top of the distillation zone and with an upflowing vapor phase, generated by the reboiling vapor that is introduced at the bottom of the zone. According to this type of technology, the gaseous stream that comprises the hydrogen that is necessary for the reaction zone for the implementation of the process according to the invention could be adjacent to the vapor phase, approximately at the inlet of at least one catalytic bed of the reaction zone.

According to the second type of technology, the catalyst is arranged in such a way that the reaction and the distillation generally proceed in an independent and consecutive manner, as is taught by, for example, the U.S. Pat. Nos. 4,847,430, 5,130,102 and 5,368,691, whereby the vapor for the distillation does not pass through virtually any catalytic bed of the reaction zone. Thus, if this type of technology is used, the process is generally such that the flow of the liquid that is to be hydrogenated is co-current to the flow of the gaseous stream that comprises hydrogen and such that the distillation vapor is virtually not in contact with the catalyst (which is reflected generally in practice by the fact that said vapor is separated from said liquid that is to be hydrogenated) for any catalytic bed of the inner portion of the hydrogenation zone. Such systems generally comprise at least one device for distribution of liquid that can be, for example, a distributor of liquid in any catalytic bed of the reaction zone. Nevertheless, to the extent that these technologies have been designed for catalytic reactions that occur between liquid reagents, they cannot be suitable unless modified for a hydrogenation catalytic reaction, for which one of the reagents, hydrogen, is in the gaseous state. For any catalytic bed of the inner portion of the hydrogenation zone, it is therefore generally necessary to add a device for distribution of the gaseous stream that comprises hydrogen, for example, according to one of the three techniques that are described below. Thus, the inner portion of the hydrogenation zone comprises at least one liquid distribution device and at least one gaseous stream distribution device comprising hydrogen in any catalytic bed of the hydrogenation zone that is inside of the distillation zone. According to a first technique, the device for distribution of the gaseous stream comprising hydrogen is arranged upstream from the liquid distribution device and therefore upstream from the catalytic bed. According to a second technique, the gaseous stream distribution device that comprises hydrogen is arranged at the level of the liquid distribution device in such a way that the gaseous stream that comprises hydrogen is introduced into the liquid upstream from the catalytic bed. According to a third technique, the gaseous stream distribution device that comprises hydrogen is arranged downstream from the liquid distribution device and therefore within the catalytic bed, preferably not far from said device for distribution of the liquid into said catalytic bed. The terms "upstream" and "downstream" that are used above are defined relative to the direction of circulation of the liquid that will pass through the catalytic bed.

One of the embodiments of the process is such that the catalyst of the inner portion of the hydrogenation zone is arranged in the reaction zone downstream from the basic device that is described in the U.S. Pat. No. 5,368,691, located in such a way that any catalytic bed of the inner portion of the hydrogenation zone is supplied by a gaseous stream that comprises hydrogen, uniformly distributed at its base, for example according to one of the three techniques described above.

When the hydrogenation zone is at least in part inside of the distillation zone, the operating conditions of the portion of the hydrogenation zone inside of the distillation zone are linked to the operating conditions of the distillation. The distillation can be conducted, for example, in such a way that its basic product contains the majority of the cyclohexane and isoparaffins with 7 carbon atoms of the feedstock, as well as the cyclohexane that is formed by hydrogenation of the benzene. It is implemented under a pressure that is generally between 0.2 and 2 MPa, preferably between 0.4 and 1 MPa, with a reflux rate of between 1 and 10, and preferably between 3 and 6. The temperature at the top of the zone is generally between 40 and 180° C., and the temperature at the bottom of the zone is generally between 120 and 280° C. The hydrogenation reaction is conducted under conditions that are most generally intermediate between those that are established at the top and at the bottom of the distillation zone, at a temperature of between 100 and 250° C., and preferably between 120 and 220° C., and at a pressure of between 0.2 and 2 MPa, preferably between 0.4 and 1 MPa. The volumetric flow rate within said hydrogenation zone, calculated relative to the catalyst, is generally between 1 and 50 $h^{-1}$ and more particularly between 1 and 30 $h^{-1}$ (volume of feedstock per volume of catalyst and per hour). The hydrogen flow rate that corresponds to the stoichiometry of the hydrogenation reactions involved is between 0.5 and 10 times said stoichiometry, preferably between 1 and 6 times said stoichiometry and even more preferably between 1 and 3 times said stoichiometry. The liquid that is subjected to the hydrogenation is supplied by a gaseous stream that comprises the hydrogen whose flow rate depends on the concentration of benzene in said liquid, and, more generally, unsaturated compounds that comprise at most six carbon atoms per molecule of the feedstock of the distillation zone. It is generally at least equal to the flow rate that corresponds to the stoichiometry of the hydrogenation reactions involved (hydrogenation of the benzene and other unsaturated compounds that comprise at most six carbon atoms per molecule, encompassed in the hydrogenation feedstock) and at most equal to the flow rate that corresponds to 10 times the stoichiometry, preferably between 1 and 6 times the stoichiometry, and even more preferably between 1 and 3 times the stoichiometry.

In the external portion of the hydrogenation zone, the catalyst is arranged in any catalytic bed according to any technology that is known to one skilled in the art under operating conditions (temperature, pressure, . . . ) that may or may not be independent, preferably independent, of the operating conditions of the distillation zone.

In the portion of the hydrogenation zone that is outside of the distillation zone, the operating conditions are generally as follows. The pressure that is required for this hydrogenation stage is generally between 0.1 and 6 MPa, preferably between 0.2 and 5 MPa, and even more preferably between 0.5 and 3.5 MPa.

The operating temperature of the hydrogenation zone is generally between 100 and 400° C., preferably between 110 and 350° C., and preferably between 120 and 320° C. The volumetric flow rate within said hydrogenation zone, calculated relative to the catalyst, is generally between 1 and 50 and more particularly between 1 and 30 $h^{-1}$ (volume of feedstock per volume of catalyst and per hour). The hydrogen flow rate that corresponds to the stoichiometry of the hydrogenation reactions involved is between 0.5 and 10 times said stoichiometry, preferably between 1 and 6 times said stoichiometry and even more preferably between 1 and 3 times said stoichiometry. The temperature and pressure conditions can also, however, within the scope of the process of this invention, be encompassed between those that are established at the top and at the bottom of the distillation zone.

In a more general way, regardless of the position of the hydrogenation zone relative to the distillation zone, the catalyst that is used in the hydrogenation zone according to the process of this invention generally comprises at least one metal that is selected from the group that is formed by nickel and platinum, used as is or preferably deposited on a substrate. At least 50% of the total weight of the metal should generally be in a reduced form. Any other hydrogenation catalyst that is known to one skilled in the art can also be selected, however.

During the use of platinum, the catalyst advantageously can contain at least one halogen in a proportion by weight relative to the catalyst that is between 0.2 and 2%. Preferably, chlorine or fluorine or the combination of the two is used in a proportion relative to the total weight of the catalyst of between 0.2 and 1.5%. In the case of the use of a catalyst that contains platinum, in general a catalyst is used such that the mean size of the platinum crystallites is less than $60 \cdot 10^{-10}$ m, preferably less than $20 \cdot 10^{-10}$ m, and even more preferably less than $10 \cdot 10^{-10}$ m. In addition, the total proportion of platinum relative to the total weight of catalyst is generally between 0.1 and 1% and preferably between 0.1 and 0.6%.

In the case of the use of nickel, the proportion of nickel relative to the total weight of catalyst is between 5 and 70%, more particularly between 10 and 70%, and preferably between 15 and 65%. In addition, in general a catalyst is used such that the mean size of the nickel crystallites is less than $100 \cdot 10^{-10}$ m, preferably less than $80 \cdot 10^{-10}$ m, and even more preferably less than $60 \cdot 10^{-10}$ m.

The substrate is generally selected from the group that is formed by alumina, silica-aluminas, silica, zeolites, active carbon, clays, aluminous cements, rare earth oxides and alkaline-earth oxides, alone or mixed. An alumina- or silica-based substrate, with a specific surface area of between 30 and 300 $m^2/g$, preferably between 90 and 260 $m^2/g$, is preferably used.

The invention claimed is:

1. A process for treating two feedstocks, wherein the first feedstock contains, for the most part, hydrocarbons that comprise at least 4 carbon atoms per molecule and that comprise at least one unsaturated compound including benzene, comprising treating said first feedstock in a distillation zone, a drainage zone, and a rectification zone, associated with a hydrogenation reaction zone, at least in part outside of the distillation zone, comprising at least one catalytic bed, in which the hydrogenation of at least one portion of the unsaturated compounds contained in the first feedstock is carried out in the presence of a hydrogenation catalyst and a gaseous stream that comprises hydrogen, wherein the first feedstock of the reaction zone is sampled at at least one sampling level in the distillation zone, wherein the effluent from the reaction zone is at least in part reintroduced into the distillation zone at at least one reintroduction level to ensure the continuity of the distillation and to discharge —at the top of the distillation zone, in a lateral draw-off in the distillation zone, and at the bottom of the distillation zone —an effluent that is low in unsaturated compounds, wherein said process comprises treating at least a second feedstock, which comprises at least one unsaturated compound including benzene, at least partially directly injected into the hydrogenation reaction zone that is outside of the distillation zone, wherein the second feedstock has a mean benzene content of 2 to 10% by volume.

2. A process according to claim 1, wherein the lateral draw-off is implemented above a return line of the reaction zone.

3. A process according to claim 1, wherein the lateral draw-off is carried out below a return line of the reaction zone.

4. A process according to claim 1, wherein part of the second feedstock is injected into the inner hydrogenation zone of the distillation column.

5. A process according to claim 1, wherein the second feedstock contains hydrocarbons that comprise at least 4 carbon atoms per molecule.

6. A process according to claim 1, wherein the second feedstock contains a $C_5/C_6$ fraction of a straight-run distillation light naphtha type, and/or of a naphtha type that is produced by a hydrocracking unit, and/or by fractions that are enriched with benzene and/or toluene and are low in sulfur and nitrogen that are obtained from catalytic cracking, and/or by gasoline fractions that contain fractions that are enriched with benzene and/or toluene and that are low in sulfur and nitrogen that are obtained from coking or viscoreduction units, and/or by fractions that are enriched with benzene and/or toluene, low in sulfur and nitrogen, and obtained after cracking of olefins or oligocracking, and/or by fractions that are rich in benzene and/or toluene, low in sulfur and nitrogen, and obtained from a unit for production of olefins by steam-cracking.

7. A process according to claim 1, wherein the second feedstock contain at least one feedstock that is

- hydrocarbons that comprise at least 4 carbon atoms per molecule,
- a $C_5/C_6$ fraction of the straight-run distillation light naphtha type,
- a $C_5/C_6$ fraction of a naphtha type that is produced by a hydrocracking unit,
- a gasoline fraction of a catalytic cracking core that is enriched with benzene relative to a complete gasoline of catalytic cracking,
- a fraction of light gasolines from a coking unit that is enriched with benzene relative to a complete coking gasoline,
- a fraction that is enriched with benzene that is obtained after separation and hydrotreatment of gasolines obtained from cracking olefins or oligocracking, or
- a benzene-rich fraction that is obtained from a unit for producing olefins by steam-cracking.

8. A process according to claim 1, wherein the distillation is carried out under a pressure of between 0.2 and 2 MPa, with a reflux rate of between 0.5 and 10, wherein the temperature of the top of the distillation zone is between 40 and 180° C. and the temperature of the bottom of the distillation zone is between 120 and 280° C.

9. A process according to claim 1, wherein the hydrogenation reaction zone is completely outside of the distillation zone.

10. A process according to claim 1, wherein a portion of the effluent from the hydrogenation reactor is recycled at the inlet of said hydrogenation reactor.

11. A process according to claim 1, wherein the hydrogenation reaction zone is both partially incorporated in the rectification zone of the distillation zone and partially outside of the distillation zone.

12. A process according to claim 11, wherein the hydrogenation reaction, carried out in the portion of the hydrogenation zone that is inside of the distillation zone, is conducted at a temperature of between 100 and 200° C., at a pressure of between 0.2 and 2 MPa, a volumetric flow rate within the inner hydrogenation reaction zone, calculated relative to the catalyst, encompassed between 1 and 50 $h^{-1}$, and the flow rate of the hydrogen that supplies the hydrogenation reaction zone is between 0.5 and 10 times the flow rate that corresponds to the stoichiometry of the hydrogenation reactions that are involved.

13. A process according to claim 12, wherein the hydrogenation catalyst is in contact with a downflowing liquid phase and with an upflowing vapor phase for any catalytic bed of the inner portion of the hydrogenation reaction zone.

14. A process according to claim 13, wherein the gaseous stream that comprises the hydrogen that is necessary for the hydrogenation reaction zone is adjacent to the vapor phase, approximately at the inlet of at least one catalytic bed of the hydrogenation reaction zone.

15. A process according to claim 11, wherein the flow of a liquid that is to be hydrogenated is co-current to the flow of the gaseous stream that comprises hydrogen for any catalytic bed of the inner portion of the hydrogenation reaction zone.

16. A process according to claim 11, wherein the flow of a liquid that is to be hydrogenated is co-current to the flow of the gaseous stream that comprises hydrogen and such that the distillation vapor is virtually not in contact with the catalyst, for any catalytic bed of the inner portion of the hydrogenation reaction zone.

17. A process according to claim 1, wherein the hydrogenation reaction that is carried out in the portion outside of the distillation zone is carried out at a pressure of between 0.1 and 6 MPa, a temperature of between 100 and 400° C., and a volumetric flow rate within the hydrogenation reaction zone, calculated relative to the catalyst, between 1 and 50 $h^{-1}$, and a hydrogen flow rate that corresponds to the stoichiometry of the hydrogenation reactions involved is between 0.5 and 10 times said stoichiometry.

18. A process according to claim 1, further comprising conducting an isomerization stage in the hydrogenation reactor at the same time as the hydrogenation reaction.

19. A process according to claim 1, further comprising conducting an isomerization stage outside of the hydrogenation reactor and downstream from the hydrogenation stage.

20. A process according to claim 1, wherein the catalyst that is used in the hydrogenation reaction zone comprises at least one metal that is nickel, zirconium, or platinum.

21. A process according to claim 20, wherein the metal is on a chlorinated alumina or zeolitic alumina substrate.

* * * * *